US008469594B2

(12) United States Patent
Gerbault

(10) Patent No.: US 8,469,594 B2
(45) Date of Patent: Jun. 25, 2013

(54) CLOSURE STRIP FOR A BAG AND ASSOCIATED BAG

(75) Inventor: Eric Gerbault, Beauchamp (FR)

(73) Assignee: S2F Flexico, Henonville (FR)

( * ) Notice: Subject to any disclaimer, the term of this patent is extended or adjusted under 35 U.S.C. 154(b) by 253 days.

(21) Appl. No.: 13/035,874

(22) Filed: Feb. 25, 2011

(65) Prior Publication Data

US 2011/0211777 A1 Sep. 1, 2011

(30) Foreign Application Priority Data

Feb. 26, 2010 (FR) ..... 10 51421

(51) Int. Cl.

| | |
|---|---|
| ***B65D 33/16*** | (2006.01) |
| ***B65D 33/00*** | (2006.01) |
| ***A44B 1/04*** | (2006.01) |
| ***A44B 19/00*** | (2006.01) |

(52) U.S. Cl.
USPC ..... 383/63; 383/61.2; 383/204; 383/205; 383/207; 24/399; 24/585.12

(58) Field of Classification Search
USPC ..... 383/63, 61.2, 203, 204, 210–211, 383/205, 207; 24/399, 400, 585.12
See application file for complete search history.

(56) References Cited

U.S. PATENT DOCUMENTS

| | | | | |
|---|---|---|---|---|
| 5,067,822 | A * | 11/1991 | Wirth et al. | 383/61.2 |
| 5,238,306 | A * | 8/1993 | Heintz et al. | 383/210.1 |
| 5,489,252 | A * | 2/1996 | May | 383/210.1 |
| 5,747,126 | A | 5/1998 | Van Erden et al. | |
| 5,749,658 | A * | 5/1998 | Kettner | 383/204 |
| 6,065,872 | A * | 5/2000 | Johnson | 383/63 |
| 7,182,513 | B1 * | 2/2007 | Malin et al. | 383/61.2 |
| 7,758,242 | B2 * | 7/2010 | May et al. | 383/63 |
| 2005/0008267 | A1 * | 1/2005 | Linton et al. | 383/61.2 |
| 2005/0210638 | A1 * | 9/2005 | Gradl | 24/400 |
| 2010/0014787 | A1 * | 1/2010 | Katada et al. | 383/63 |
| 2011/0243481 | A1 * | 10/2011 | Goto | 383/63 |

FOREIGN PATENT DOCUMENTS

| | | |
|---|---|---|
| EP | 0 339 324 | 11/1989 |
| EP | 0 945 359 | 9/1999 |
| GB | 2 311 274 | 9/1997 |
| WO | WO 2007/097570 | 8/2007 |

* cited by examiner

*Primary Examiner* — Jes F Pascua
(74) *Attorney, Agent, or Firm* — Blakely Sokoloff Taylor & Zafman

(57) ABSTRACT

A closure strip for a bag. Two supporting webs are provided, on their internal surfaces facing each other and at a distance from their longitudinal edges, with at least one longitudinal closure assembly. Each web has an upper portion, extending longitudinally in an upper portion thereof, and a lower portion, extending longitudinally in a lower portion of these. At least one of the webs includes internal faces which correspond to the faces of the upper and lower portions made in materials having different melting temperatures. The melting temperature of the material of the upper portion is less than the melting temperature of the material of the lower portion. The closure strip also includes a line of weakening which extends longitudinally in an intermediate area of each web. The intermediate areas are made of a third material having a lower tensile strength than the upper and lower portions.

12 Claims, 3 Drawing Sheets

CLOSURE STRIP FOR A BAG AND ASSOCIATED BAG

The invention relates to the field of bags or sachets comprising a closure assembly adapted for allowing successive openings and closings at will by the user.

More specifically, the invention relates to closure strips positioned at the mouth of the bags.

Such closure strips are conventionally formed with supporting webs provided on their internal surfaces facing each other and at a distance from their longitudinal edges, with at least one longitudinal closure assembly consisting of two complementary closure profiles.

Today, there exists a strong demand for having a tamper-evident member for such bags, that enable the user to make sure that no one has already had access to the contents of the bag.

On the market, such temper-evident members are notably made in the form of a U-shaped web positioned on the inside of the closure profiles and connecting both internal walls of the bag. Alternatively, the web may be positioned on the outside of the supporting webs, and connecting both external walls of the bag.

The U-shaped web is then laid out on the bag so that it may be broken during the first opening and may allow the user to access its contents normally and repeatedly, as described for example in document FR 2 546 481.

Nevertheless, when the user attempts to break the U-shaped web in order to open the bag, sometimes it is not the web which tears but one of the walls of the bag, such as when the U-shaped web extends on the outside of the bag.

Moreover, the manufacturing of tamper-proof closure strips comprising an internal temper-evident member is made difficult by the presence of the U-shaped web between the supporting webs or above the latter. The U-shaped web actually generates an additional thickness at the closure which may interfere during the running of the strips in traditional forming machines. Further, in the case when the closure strips are added onto the bag, the U-shaped walls of the web are susceptible to be welded together by the jaws of the machine during the welding of the strips on the mouth of the bag.

The object of the present invention is therefore to improve the closure strips and the existing bags.

For this, the invention proposes a closure strip for a bag, comprising two supporting webs provided on their internal surfaces facing each other and at a distance from their longitudinal edges, with at least a longitudinal closure assembly, each supporting web comprising two portions,

- a first of said portions, a so-called upper portion, extending longitudinally in an upper portion of the supporting web 21, and
- a second portion, a so-called lower portion, extending longitudinally in a lower portion of the supporting web, underlying the upper portion, wherein, for at least one of the webs 21, the faces of the upper and lower portions which are facing each other, so-called internal faces, are made in materials having different melting temperatures, the melting temperature of the constitutive material of the internal face of the upper portion being less than the melting temperature of the constitutive material of the internal face of the lower portion.

Preferred but non-limiting aspects of the closing strips according to the invention are the following:

- the difference between the melting temperature of the constitutive materials of the internal faces of the upper and lower portions respectively is at least equal to 20 degrees;

- the closing assembly extends in the lower portions of the supporting webs;
- the internal faces of the upper portions of the supporting webs are welded together;
- the strip further comprises a line of weakening which extends longitudinally in an intermediate area of each web extending between the upper portions and the closure assembly;
- the line of weakening is made by discontinuous cutting of the supporting webs and/or by local reduction of the thickness of the webs in each intermediate area;
- the intermediate areas are made in a third material so that said areas have lower tensile strength than the upper and lower portions;
- the other faces of the lower portions, so-called external faces, and the internal faces of said lower portions are made in materials having melting temperatures different from each other;
- the melting temperature of the constitutive material of the external faces of the lower portions is lower than that of the constitutive material of the internal faces of said lower portions;
- the internal face of the upper portion of at least one web and the external faces of the lower portions are made in a same material;
- the strip further includes a tab formed in one of its side edges, in an intermediate area extending between the upper portions and the closure assembly; and
- the closure assembly is formed by one of the elements of the following group: complementary closure profiles, hook and loop strips, self-adhesive tape.

According to a second aspect, the invention proposes a bag comprising a mouth, a bottom globally parallel to the mouth and opposite the latter, and two side edges generally parallel and connected together on three of their sides so as to form side edges, the bottom and the mouth, a closing strip according to the invention extending from its mouth.

According to a preferred but non-limiting aspect of the bag according to the invention, the closing strip is integral with the walls of the bag or added on said walls.

Other features, objects and advantages of the present invention will become apparent upon reading the detailed description which follows, and with reference to the appended drawings, given as non-limiting examples and wherein:

FIG. 1*a* is a planar view of a bag according to the invention;

FIG. 1*b* is a planar view of the bag of FIG. 1*a* further including a line of weakening and a tab;

Figure 6:
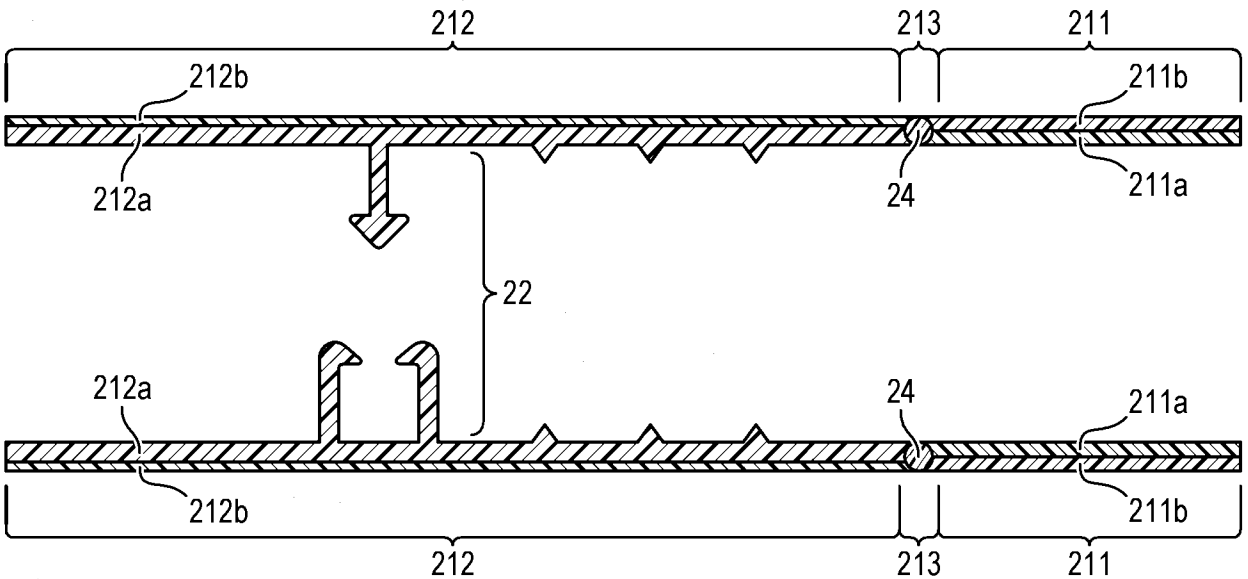

FIG. 6 is a transverse sectional view of an alternative embodiment illustrated in the appended figures, a bag 10 according to the present invention comprises a mouth 11, a bottom 12 globally parallel to the mouth 11 and opposite the latter, and two generally parallel side walls 13, 14. The side walls 13, 14 are connected to each other on three of their sides so as to form side edges 15, the bottom 12 and the mouth 11 of the bag 10.

Preferably, the side walls 13 and 14 are globally parallel to the mouth 11 and to the bottom 12 and connect the latter.

The walls 13, 14 of the bag may be made from a plastic film, in complex material sheets such as sheets of paper covered with aluminium, or in any other material conventionally used in the manufacturing of bags.

The bottom 12 and/or the side edges 15 connecting the walls 13, 14 may include bellows, thereby allowing the bag 10 to stand vertically.

A closure strip 20 extends longitudinally along the mouth 11 of the bag 10.

Figure 1A:
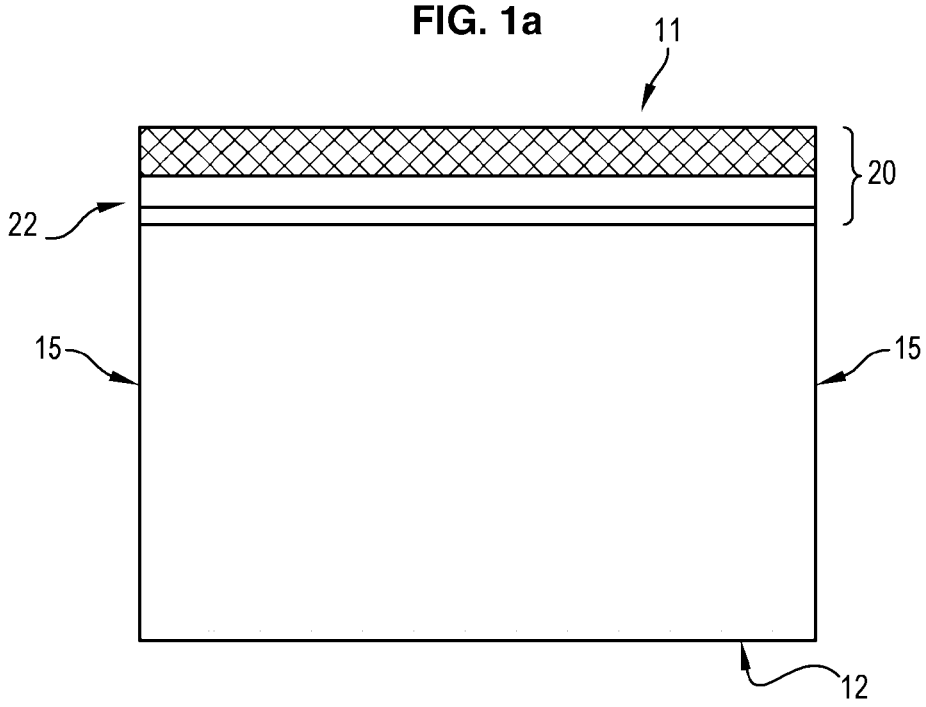
Figure 1B:
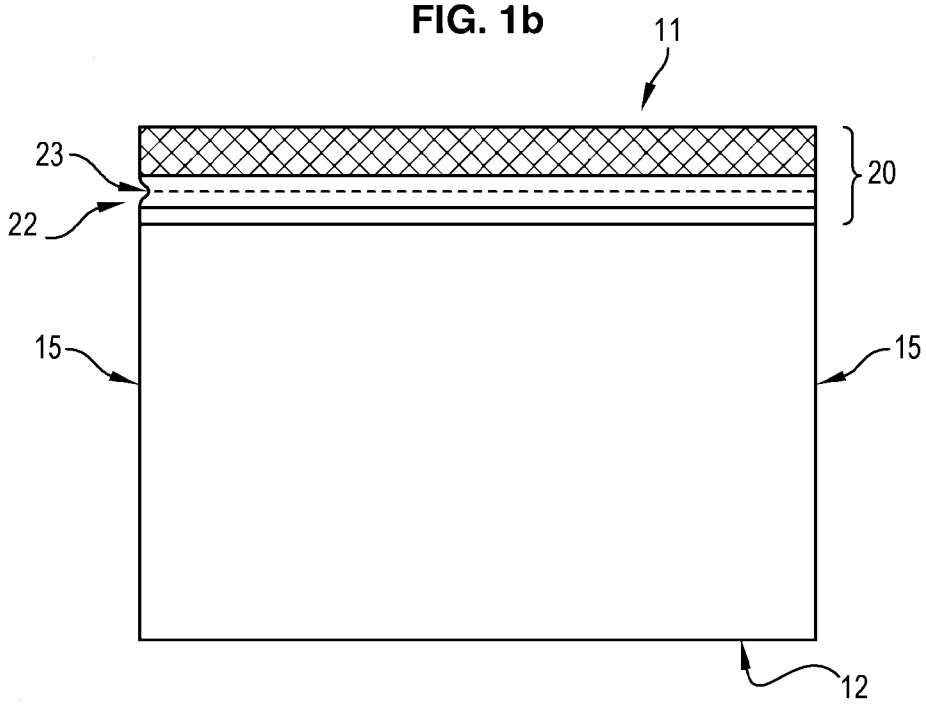
Figure 2:
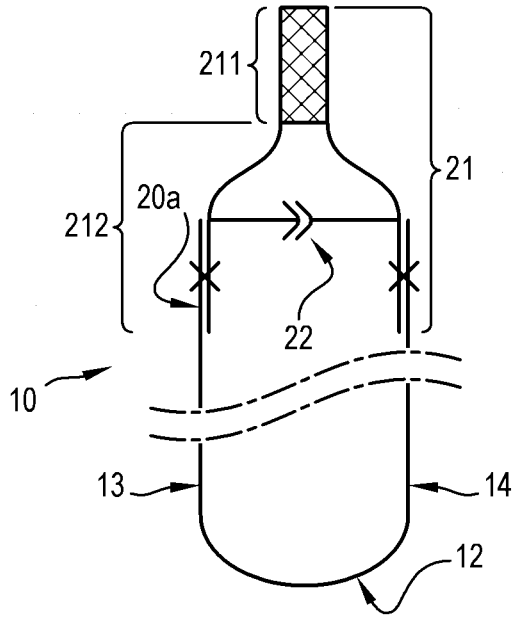
FIG. 2 is a transverse sectional view of a first embodiment of a bag according to the invention, wherein the closure strips are added on the supporting webs.
Figure 3:
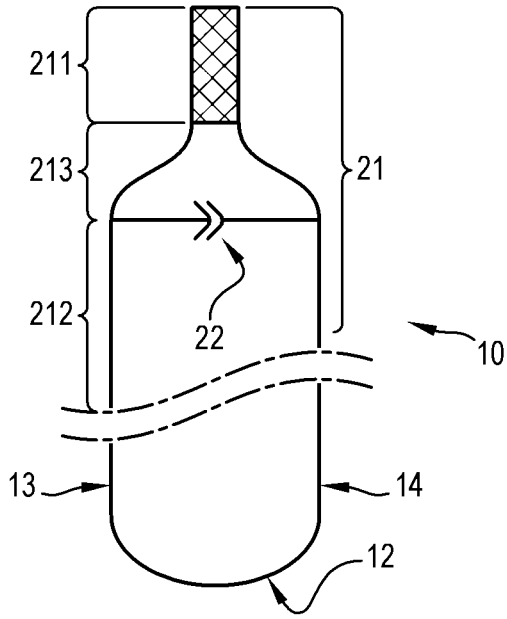
FIG. 3 is a transverse sectional view of a second embodiment of a bag according to the invention, comprising a line of weakening, and wherein the closure strips are integral with the supporting webs.
Figure 4:
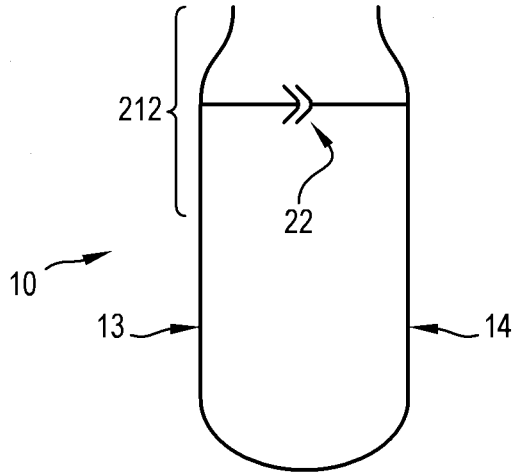
FIG. 4 is a transverse sectional view of an embodiment of a bag according to the invention after opening.
Figure 5:
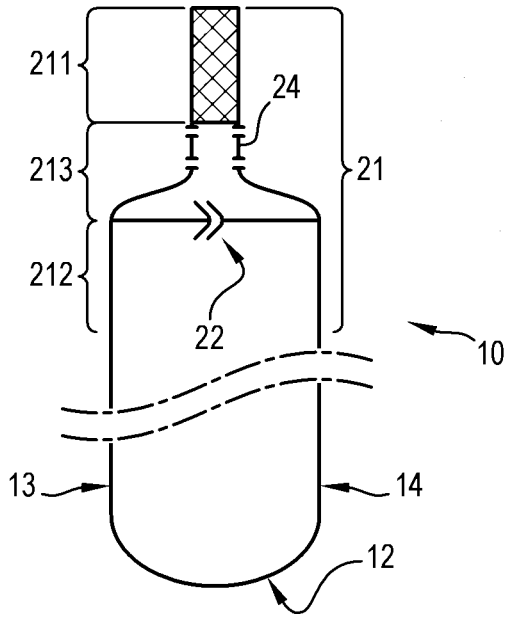
FIG. 5 is a transverse sectional view of an alternative of the embodiment of FIG. 3.

The closure strip 20 can comprise supporting webs 21 which are either integral with the walls 13 and 14, which make up the bag 10 (as illustrated in FIG. 3 or 5), or added and attached on the latter by any suitable means, such as by adhesive bonding 20*a* (FIG. 2) or welding.

Each supporting web 21 includes a first longitudinal portion 211, a so-called upper portion, and a second longitudinal portion 212, a so-called lower portion, extending underlying the upper portion 211. Here, the upper portion 211 is the farthest from the centre of the bag 10 while the lower portion 212 is the closest thereto.

According to a first embodiment, the upper portion 211 is made in a first material having a first melting temperature, while the lower portion 212 is made in a second material having a second melting temperature, different from the first melting temperature.

Here, the first melting temperature is less than the second melting temperature.

The difference between the respective melting temperatures of the first and second materials may be at least 20° C.

For example, the first material may be low density, medium density or high density polyethylene (having a melting temperature of the order of 120° C.), while the second material may be a metallocene, a polyethylene copolymer with a low melting point or a mixture of both (having a melting temperature of the order of 80° C. to 100° C.).

The closure webs 21 are provided on their internal surfaces 211*a*, 212*a* facing each other and at a distance from the mouth 11 with at least one longitudinal closure assembly 22.

These may be complementary closing profiles, hook and loop strips, a self-adhesive tape, or any other equivalent means.

The closure assembly 22 extends underlying the upper portion of the webs 211, preferably in the lower portion 212, at a distance from the upper portion 211.

According to a first embodiment, each web 21 of the closure strips 20 is formed by continuous and simultaneous co-extrusion of both materials forming the upper 211 and lower 212 portions. The interface between both portions 211 and 212 of the webs 21 is then a strip made in a material formed with a mixture between the first material and the second material.

According to a second embodiment, the upper portion 211 and the lower portion 212 are formed separately and then attached together by welding, adhesive bonding, or any other conventional attachment means. The interface between the upper portion 211 and the lower portion 212 therefore forms a discontinuity between both materials.

With such supporting webs 21, it is then possible to easily form the temper-evident member of a tamperproof closure strip 20.

Indeed it is sufficient to weld the supporting webs 21 together at a predetermined temperature, pressure and for a predetermined time, for example by superposing the supporting webs 21 and by applying welding jaws on at least the upper portion of the webs 21.

The welding time, pressure and temperature are selected so that only the upper portion 211 of the closure strips 20 on which the jaws are applied, is welded. Indeed, at equal thicknesses, as the melting temperature of the second material is higher by at least twenty degrees, the heat diffusion through the second material layer of the lower portion 212 is slower than through the first material layer of the upper portion 211. This diffusion may moreover be accelerated by reducing the first material layer relatively to the second material layer. It is therefore not necessary to place complex devices to avoid the application of the welding jaws on the totality of the webs 21, since the choice of the materials of the upper 211 and lower 212 portions as well as that of the welding conditions imply that the lower portion 212 cannot be welded with the remainder of the supporting webs 21.

For example, for strips made in low density polyethylene (melting temperature of the order of 120° C.) and in metallocene (melting temperature of the order of 80° C.), the welding jaws are applied at a temperature of the order of 140° C.

By welding the upper portions 212 of the supporting webs 21, it is further possible to stiffen the upper portion of the closure strip which is accessible to the user, and therefore facilitate its handling.

The user may therefore easily open the bag 10 while holding the bag 10 with one hand, for example at the closure assembly 22, and by pulling with the other hand on the upper portion of the closure strip 20. Because of the lesser strength of the intermediate area 213 of the webs 21 located between the upper portion of the strip (stiffened by the weld) and its lower portion (stiffened by the closure assembly), the supporting webs 21 tend to tear longitudinally between the upper portion and the closure assembly, and more particularly at the interface line between the stiffened upper portion and the intermediate area, thereby leaving the walls 13, 14 intact.

Once the temper-evident member is removed, it is visible that the bag 10 has already been opened a first time, and its closure assembly 22 is easily accessible.

If a malicious third party attempted to open the bag 10 and to access its contents, it would therefore be impossible for him/her to do this without tearing the stiffened upper portion of the tamperproof closure strip 20 and visibly and permanently indicating the prior opening of the bag 10.

According to a second embodiment, illustrated in FIG. 6, the upper portions 211 and/or the lower portions 212 are bimaterials, i.e. they are themselves made in two different materials: their internal faces 211*a*, 212*a*, which are facing each other when they are attached on the bag 10, and/or their external faces which are oriented towards the outside of the bag 10, are made in different materials.

The closure strip 20 then consists of a bimaterial upper portion 211, with an internal face 211*a* made in the first material (having a lower melting temperature) and an external face 211*b* made in the second material (having a higher melting temperature) and of a homogeneous lower portion 212, the internal 212*a* and external 212*b* faces of which are both made in the second material.

The closure strip 20 may then consist of a homogeneous upper portion 211, the internal 211*a* and external 211*b* faces of which are both made in the first material, and of a bimaterial lower portion 212, having an internal face 212*a* made in the second material and an external face 211*b* made in the first material.

According to still a further embodiment, the upper portion 211 and the lower portion 212 may both be bimaterials: the upper portion 211 then comprises an internal face 211*a* made in the first material and an external face 211*b* made in the second material, while the lower portion 212 comprises an internal face 212*a* made in the second material and an external face 212*b* made in the first material.

Advantageously, the closure strip of these three alternative embodiments has a more aesthetical and cleaner finish than the closure strip of the first alternative embodiment, where the upper 211 and lower 212 portions are homogeneous and respectively formed with the first material and with the second material.

Thus, when the welding jaws are applied on the webs 21, only the internal faces 211*a* of the upper portions 211 are welded together, since the melting temperature of the second material (constitutive of the internal faces 212*a* of the lower portion 212) is higher.

Of course it is possible to act on the respective thicknesses of the first and second material layers forming the internal 211*a*, 212*a* and external 211*b*, 212*b* faces of the upper 211 and lower 212 portions in order to adjust heat diffusion through the latter and therefore the welding conditions.

Moreover, making the external face 211*b* of the lower portion 211 in a material having a melting temperature below the melting temperature of its internal face 212*a* allows improvement in the welding quality of the webs 21 on the mouth of the bag 10 and adjustment of the height on which the webs 21 are attached on the mouth 11 of the bag 10.

Indeed, when welding jaws are applied on the webs 21 in order to attach the strip 20 onto the mouth 11 of the bag 10 on the one hand and to weld together the upper portions 211 of the webs 21, on the other hand, the external faces 212*b* of the lower portions 212 are found attached on the walls 13, 14 of the bag while their internal faces 212*a*, which are made of a material having a higher melting temperature, remain separate and do not weld to each other.

Moreover, it is possible to adjust the height of the webs 21 attached onto the mouth 11 of the bag 10 by applying the welding jaws over the whole or part of the lower portion 212 of the webs.

Indeed, conventional welding jaws generally comprise welding jaws formed with welding bars either U-shaped or in two portions and adapted for welding the webs 21 on either side of the closure assembly 22 in order to prevent its deterioration.

Thus, if the external face 211*a* of the lower portions 211 is made in the first material (having a lower melting temperature), it is possible to selectively apply the welding bars on the whole of the lower portion (211), thereby attaching the whole of the lower portion 211 onto the webs 21, or only on a fraction of the lower portions 211, for example on the underlying portion of the closure assembly 22, so that only the underlying portion of the closure assembly is attached onto the bag 10, while avoiding welding of the internal faces 211*b* to each other.

By making a closure strip having a lower portion 211 which is larger than the upper portion 212, as illustrated in FIG. 6, it is therefore possible to easily attach the closure strip 20 at a more or less long distance from the mouth 11 by applying the welding bars onto a more or less substantial area of the lower portion 211.

A same closure strip 20 therefore actually allows adjustment of the height of the webs 21 which is attached on the mouth 11 of the bag during the automatic manufacturing of the bag 10.

In order to simplify the description, we have described the embodiment wherein the closure strip 20 is made in two distinct materials. Nevertheless, this is by no means limiting: the internal 211*a*, 212*a* and external 212*b*, 212*b* portions may be made in four distinct materials, while the melting temperature of the constitutive material of the internal face 211*a* of the upper portion 211 is less than the melting temperature of the constitutive material of the internal face 212*a* of the lower portion 212 portion. Optionally, the constitutive material of the external face 212*b* of the lower portion 212 may also be selected so that its melting temperature is less than that of the constitutive material of the internal face 212*a*.

Moreover, it is also possible that only one of the webs 21 of the closure strip is provided with an internal face 211*a* made in a material having a melting temperature below the melting temperature of the constitutive material of the internal face 212*a* of the lower 212, the other web then comprising internal faces 211*a*, 212*a* made in the same material or in a material having a similar melting temperature.

It has already be seen that the intermediate area 213 located between the upper portion 211 of the supporting webs 21 and the closure assembly 22 has a less substantial tear strength as compared with the areas which are adjacent to it.

In order to still further facilitate the first opening of the bag 10, the supporting webs 21 may further comprise a longitudinal line of weakening 24 in the area 213, a line along which the tear strength is further reduced relatively to that of the area 213.

For example, the line of weakening 24 may be a discontinuous cut of the area 213 of the webs 21 (FIG. 5) and/or is made by locally reducing the thickness of all or part of the area 213.

Alternatively (illustrated in FIG. 3), the intermediate area 213 of the supporting webs 21 is made in a third material distinct from the first and second materials, so that its tensile strength (and therefore its tear strength) are both lower than those of the upper portion of the strip 20 and of the lower portions of the webs 21.

Preferably, the melting temperature of the constitutive material of the intermediate area 213 is also higher than that of the constitutive material of the internal face 211*a* of the upper portion 211, in order to guarantee direct access to the closure assembly 22 during the first opening of the bag 10.

Nevertheless, the intermediate area 213 may alternatively be made in a material having a melting temperature substantially equal to, or even less than that of the internal face 211*a* of the upper portion 211, while the obtained breakage strength after welding the walls of the web 21 remains lower than that of the upper and lower portions of the strip 20.

For example, the first constitutive material of the internal face 211*a* of the upper portion 211 and of the external face 212*b* of the webs 21 may be low density polyethylene. The second constitutive material of the internal face 212*a* of the lower portion 212 and of the external face 211*b* may then be metallocene, while the third constitutive material of the intermediate area 213 may be polypropylene or a high density polyethylene.

Alternatively, the entirety of the upper portion 211 may be made in low density polyethylene, the entirety of the lower portion 212 may be made in metallocene and the intermediate area may be made in polypropylene.

Finally, in order to further facilitate the opening of the bag 10, the closure strips 30 may further comprise a tab 23. This may be for example a V-shaped or dihedral cut of the supporting webs opening onto one of the side edges of the strip 20.

Advantageously, the tab is made in the intermediate area 213.

Finally, in the case when the strips 20 already include a line of weakening 24, the tab 12 is preferably made in the alignment of the line 24.

The invention claimed is:

1. A closure strip for a bag, comprising two supporting webs provided, on their internal surfaces facing each other and at a distance from their longitudinal edges, with at least one longitudinal closure assembly, each supporting web comprising:

an upper portion, extending longitudinally in an upper portion of the supporting web, and a lower portion, extending longitudinally in a lower portion of the supporting web, underlying the upper portion, wherein, for at least one of the webs, the internal faces, which correspond to the faces of the upper and lower portions which are facing each other, are made of materials having different melting temperatures, the melting temperature of the constitutive material of the internal face of the upper portion being less than the melting temperature of the constitutive material of the internal face of the lower portion, wherein the closure strip further comprises a line of weakening which extends longitudinally in an intermediate area of each web extending between the upper portions and the closure assembly, and said intermediate area of each web is made of a third material so that said intermediate areas have a lower tensile strength than the upper and lower portions.

2. The closure strip according to claim 1, wherein the difference between the melting temperatures of the constitutive materials of the internal faces of the upper and lower portions respectively is at least equal to 20 degrees.

3. The closure strip according to claim 1, wherein the closure assembly extends in the lower portions of the supporting webs.

4. The closure strip according to claim 1, wherein the internal faces of the upper portions of the supporting webs are welded together.

5. The closure strip according to claim 1, wherein the line of weakening is selected from the group consisting of discontinuous cutting of the supporting webs and local reduction in the thickness of the webs in each intermediate area.

6. The closure strip according to claim 1, wherein the other faces of the lower portions, and the internal faces of said lower portions are made of materials having melting temperatures different from each other.

7. The closure strip according to claim 6, wherein the melting temperature of the constitutive material of the other faces of the lower portions is lower than the melting temperature of the constitutive material of the internal faces of said lower portions.

8. The closure strip according to claim 6, wherein the internal face of the upper portion of said at least one web and the other faces of the lower portions are made of the same material.

9. The closure strip according to claim 1, further comprising a tab formed in a side edge thereof, in an intermediate area extending between the upper portions and the closure assembly.

10. The closure strip according to claim 1, wherein the closure assembly is formed by one of the elements from the following group: complementary closure profiles, hook and loop strips, self-adhesive tape.

11. A bag comprising a mouth, a bottom globally parallel to the mouth and opposite the latter, and two side walls generally parallel and connected together on three of their sides so as to form side edges, the bottom and the mouth, wherein said bag comprises a closure strip extending from its mouth according to claim 1.

12. The bag according to claim 11, wherein the closure strip is one of integral with the walls of the bag, and added onto said walls.

* * * * *